United States Patent [19]

Russell, Jr.

[11] 4,247,597

[45] Jan. 27, 1981

[54] ELECTROSCOPIC CARRIER PARTICLES HAVING A CARBOXYLIC ACID SURFACE TREATMENT

[75] Inventor: John J. Russell, Jr., Woodbury, Conn.

[73] Assignee: Pitney Bowes, Inc., Stamford, Conn.

[21] Appl. No.: 920,208

[22] Filed: Jun. 28, 1978

Related U.S. Application Data

[63] Continuation-in-part of Ser. No. 811,773, Jun. 30, 1977, abandoned.

[51] Int. Cl.[3] ..... G03G 13/08; G03G 13/09

[52] U.S. Cl. ..... 428/403; 428/407

[58] Field of Search ..... 428/403, 404, 407, 402; 427/216; 96/1 S, 1 D, 15 D; 252/62.1 P

[56] References Cited

U.S. PATENT DOCUMENTS

| | | | |
|---|---|---|---|
| 3,922,381 | 11/1975 | Datta | 427/216 |
| 3,989,648 | 11/1976 | Lenhard | 428/403 |
| 4,063,000 | 12/1977 | Aonuma | 428/403 |
| 4,071,655 | 1/1978 | Brana | 428/403 |
| 4,073,980 | 2/1978 | Westdale | 428/403 |
| 4,113,641 | 9/1978 | Brana | 428/403 |

*Primary Examiner*—Marion McCamish

*Attorney, Agent, or Firm*—Peter Vrahotes; William D. Soltow, Jr.; Albert W. Scribner

[57] ABSTRACT

Disclosed is a treatment of electroscopic carrier particles with a solution of non-halogenated carboxylic acids. Preferably, the carboxylic acid solution is first passed through a dry agent to assure its anhydrous nature. The carrier particles are added to and agitated within the solution a sufficient period to assume complete wetting of the particles. After decanting and filtering, the carrier particles are dried. Carrier particles treated in this manner are less susceptible to oxidation and have particular utility for use in development powders for magnetic brush development units of electrophotography copier equipment.

3 Claims, No Drawings

ELECTROSCOPIC CARRIER PARTICLES HAVING A CARBOXYLIC ACID SURFACE TREATMENT

CROSS-REFERENCE TO RELATED APPLICATION

This is a continuation-in-part of U.S. application Ser. No. 811,773, filed June 30, 1977, and now abandoned.

BACKGROUND OF THE INVENTION

With the increased use of plain paper copiers, development powders have enjoyed an increased popularity over liquid toners. Along with the increased use of development powders, magnetic brush units are becoming increasingly popular as opposed to cascading methods. Development powders used with magnetic brush units usually have an iron powder which serves as the carrier material. Inexpensive, untreated iron powders cannot be used in magnetic brush systems since such iron does not have sufficient stability toward rusting and has color and triboelectric charging properties adversely effected by variable humidity conditions. More specifically, the charge to mass ratio (C/M) of the carrier particles will decrease drastically upon exposure to high relative humidity. In order to solve this problem, those in the art have resorted to chemical plating and coating of the iron particles with polymers, oils, waxes and the like and have tried various treatments.

One method described in the literature for the treating of carrier particles is with perfluorinated carboxylic acid. Although this treatment has proven successful, the cost of such materials is relatively high and the number of solvents available for forming treating solutions is limited.

Another problem with prior art developer powders, which are employed in automatic copy machines, is carrier filming problems due to the mechanical rubbing of the carrier surface with the soft toner resins. The gradual accumulation of permanently attached film impairs the normal triboelectric charging of the toner particles in the toner mix. As a result, the toner is either less highly charged or sometimes oppositely charged giving rise to poor copy quality with a high degree of background.

In the literature, several types of plastic coating and electroplating of the carrier have been suggested to overcome the filming problems. Most of the prior art coating methods result in high cost and have other disadvantages such as yielding improper triboelectric charge properties and imparting a very high electrical resistance to the carrier that reduces its development electrode effect and results in poorly filled-in large image areas.

SUMMARY OF THE INVENTION

In the art of electrostatographic imaging processing, an electrostatic latent image is formed on a recording surface of a photoconductor. The electrostatic image may then be developed by finely-divided toner particles electrostatically carried by the surface of carrier particles. Preferably, the carrier particles are iron powder or beads.

It has been found that a simple adsorption treatment of iron powder with a carboxylic acid solution produces a treated iron which has good stability to rusting under high relative humidity, a constant triboelectric charge property under all conditions when mixed with standard toners, low dusting of the toner in a magnetic brush unit and the treatment allows the use of lower biased voltage during development which improves the reliability of machine performance.

By using the treated carrier particles of this invention, an improved electrophotographic process is obtained. In this improved process, a latent electrostatic image is contacted with a developer mixture including the treated carrier particles of this invention. Additionally, the process yields an inexpensive way of treating carrier particles and the process may be carried out with a wide selection of solvents.

DESCRIPTION OF THE PREFERRED EMBODIMENT

The core of the carrier particle formed by the present invention may be any material which can react chemically with the carboxylic acid compounds of this invention. Thus, by way of example, the material of the core of the carrier particle may be sand, glass beads, metallic beads or metallic powders. As used in this specification, including the appended claims, the term metal and metallic is intended to include elemental metals as well as their oxides, carbides and other forms of metallic compounds and alloys which have a solid form.

The core of carrier particles of the preferred embodiment is a ferromagnetic material such as iron or steel. Other suitable ferromagnetic materials such as magnetic oxides and alloys of copper-nickel-iron, for example, also may be employed. The size of the core may be between 40 and 1000 microns with the preferred size range being between 50 and 400 microns.

The carboxylic acid may be selected from a number of classes including aliphatic, branched and unbranched, substituted and unsubstituted, and aromatic, substituted and unsubstituted.

In the use of such carboxylic acids it has been found preferable to assure the anhydrous nature of such acids. This is accomplished by passing the carboxylic acid through a drying agent such as a desiccant or molecular sieve immediately prior to use.

Examples of suitable carboxylic acids are as follows:

ALIPHATIC CARBOXYLIC ACIDS 4-acetamidoubutyric acid
acetic acid, glacial
11,3-acetonedicarbyxylic acid
4-acetylbutyric acid
acetylenedicarboxylic acid
N-acetylmuramic acid
aconitic acid
acrylic acid
1-adamantaneacetic acid
1,3-adamantanediacetic acid
adipic acid
adipic acid monoethyl ester
adipic acid monomethyl ester
$\beta$-alanine
DL-2-aminoadipic acid
3-aminobutyric acid
4-aminobutyric acid
6-aminocaproic acid
12-aminododecanoic acid
DL—3-amino-3-hydroxybutyric acid
pp-aminophenylacetic acid
3-amino-3-phenylpropionic acid
11-aminoundecanoic acid 5-aminovaleric acid
azelaic acid
azelaic acid monomethyl ester
4,4'-azobis-(4-cyanovaleric acid)
5-benzamidovaleric acid
Benzilic acid
1,4-benzodioxan-6-acetic acid
4-benzoylbutyric acid
benzoylformic acid
3-benzoylpropionic acid
5-benzylvaleric acid
benzylmalonic acid

ALIPHATIC CARBOXYLIC ACIDS 5-benzyloxyindole-3-acetic acid
S-benzylthioglycolic-acid
2,2-Bis-(hydroxymethyl)-propionic acid
tert.-butylacetic acid
n-butyric acid
cacotheline
N-carbobenzyloxy-L-aspartic acid
cholesteryl hydrogen succinate
cholic acid
cinnamylidenemalonic acid
citraconic acid
citric acid
crotonic acid
cyanoacetic acid
cyclohexanebutyric acid
1,1-cyclohexanediacetic acid
cyclohexanepropionic acid
cyclohexylacetic acid
cyclohexyphenylacetic acid
cyclohexylphenylglycolic acid
2-cyclopeniene-1-acetic acid
cyclopentylacetic acid
3-cyclopentylpropionic acid
1,10-decanedicarboxylic acid
decanoic acid
decanoic acid
deoxycholic acid
diglycolic acid
2,5-dihydroxy-p-benzenediacetic acid
3,4-dihydroxyhydrocinnamic acid
dihydroxymaleic acid
DL-3,4-dihydroxymandelic acid
3,4-dihydroxyphenylacetic acid
dihydroxytartaric acid
(2,5-dimethoxyphenyl)-acetic acid
(3,4-dimethoxyphenyl)-acetic acid
3-(3,4-dimethoxyphenyl)-propionic acid
3,3-dimethylacrylic acid
3,3-dimethylglutaric acid
dimethylmalonic acid
2,2-dimethylsuccinic acid
diphenylacetic acid
2,2-diphenylpropionic acid
3,3-diphenylpropionic acid
meso-2,3-diphenylsuccinic acid
dithiodiglycolic acid
3,3'-dithiodipropionic acid
di-p-toluoyl-d-tartaric acid
di-p-tolyacetic acid
1,12-dodecanedicarboxylic acid
eicosanoic acid
elaidic acid
erucic acid
ethyxyacetic acid
4-ethoxy-3-methoxyphenylacetic acid

ALIPHATIC CARBOXYLIC ACIDS p-ethoxyphenylacetic acid
3-ethoxypropionic acid
3-ethoxypropionic acid
2-ethylhexanoic acid
2-ethyl-2-hydroxybutyric acid
5-ethyl-3-indoleacetic acid
ethylmalonic acid
2-ethyl-2-methylsuccinic acid
formic acid
o-formylphenoxyacetic acid
fumaric acid
fumaric acid monoethyl ester
furylacrylic acid
gluconic acid
glutaconic acid
glutaric acid
glyceric acid
glycolic acid
n-heptadecanoic acid
heptanoic acid
hexadecanedioic acid
2,4-hexadienoic acid
hexanoic acid
hexanoic acid
homophthalic acid
homovanillic acid
5-hydantoinacetic acid
hydrocinnamic acid
trans-$\beta$-hydromuconic acid
33-hydroxybutyric acid
16-hydroxyhexadeccccanoic acid
5-hydroxyindole-3-acetic acid
2-hydroxyisobutyric acid
2-hydroxyisobutyric acid
m-hydroxymandelic acid
2-hydroxy-2-methylbutyric acid
o-hydroxyphenylacetic acid
m-hydroxyphenylacetic acid
p-hydroxyphenylacetic acid
3-(p-hydroxyphenyl)-propionic acid
p-hydroxyphenylpyruvic acid
3-hydroxypropionic acid
indole-3-acetic acid
3-indoleacrylic acid
3-indolebutyric acid
DL-$\beta$-3-indolelactic acid
indole-3-pyruvic acid
isobutyric acid
itaconic acid
2-ketobutyric acid
2-ketoglutaric acid
ketomalonic acid monohydrate
4-ketopimelic acid
DL-lactic acid
DL-lactic acid

ALIPHATIC CARBOXYLIC ACIDS

L-(+)-lactic acid
lauric acid
levulinic acid
linolenic acid
maleic acid
dd-malic acid
DL-malic acid
l-malic acid malonic acid
d-mandelic acid
DL-mandelic acid
l1-mandelic acid
1-menthoxyacetic acid
mercaptoacetic acid
3-mercaptopropionic acid
mercaptosuccinic acid
mesaconic acid
methacrylic acid
3-(p-methoxybenzoyl)-propionic acid
5-methoxyindole-3-acetic acid
5-methoxy-2-methyl-3-indoleacetic acid
3-methoxyphenylacetic acid
4-methocyphenylacetic acid
4-(p-methoxyphenyl)-butyric acid
3-(o-methoxyphenyl)-propionic acid
3-(o-methoxyphenyl)-propionic acid
(+)-3-methyladipic acid
3-methyladipic acid
methylaminomethyltartronic acid
3,4-methylenedioxycinnamic acid
mono-methy glutarateetic acid
2-methylglutaric acid
3-methylglutaric acid
methylmalonic acid
mono-methyl succinate
methylsuccinic acid
β-methyitricarballylic acid
mucic acid
trans,trans-muconic acid
muramic acid
myristic acid
myristic acid
(2-naphthoxy)-acetic acid
1-naphthylacetic acid
2-naththyla
cetic acid
3,3′,3″-nitrilotripropionic acid
o-nitrophenylacetic acid
m-nitrophenylacetic acid
p-nitrophenylacetic acid

ALIPHATIC CARBOXYLIC ACIDS 4-(p-nitrophenyl)-butyric acid
o-nitrophenylpyruvic acid
3-nitropropionic acid
nonanoic acid
2-norbornaneacetic acid
5-norbornene-2-acrylic acid
octanoic acid
octanoic acid
trans-2-octenoic acid
oxalacetic acid
oxamic acid
palmitic acid
n-pentadecanoic acid
phenoxyacetic acid
2-phenoxybutyric acid
3-phenoxypropionic acid
11-phenoxyundecanoic acid
phenylacetic acid
2-phenylbutyric acid
3-phenylbutyric acid
4-phenylbutyric acid
o-phenylenediacetic acid
m-phenylenediacetic acid
p-phenylenedipropionic acid
L-(−)-3-phenyliactic acid
phenylmalonic acid
phenylpropiolic acid
2-phenylpropionic acid
5-phenyl-2-pyrrolepropionic acid
phenylsuccinic acid
5-phenylvaleric acid
pimelic acid
cis-pinonic acid
propiolic acid
propionic acid
2-pyridylacetic acid hydrochloride
3-pyridylacetic acid hydrochloride
β-(3-Pyridyl)-acetic acid
pyruvic acid
sebacic acid
stearic acid
styrylacetic acid
suberic acid
succinamic acid
succinic acid
d-tartaric acid
DL-tartaric acid hydrate
l-tartaric acid
meso-tartaric acid hydrate
tartronic acid
3-3-tetramethyleneglutaric acid
4-thianaphtheneacetic acid
3-(2-thienyl)-acrylic acid
4-(2-thienyl)-butyric acid

ALIPHATIC CARBOXYLIC ACIDS

S-(thiobenzoyl)-thioglycolic acid
DL-thioctic acid
thiodiglycolic acid
3,3′-thiodipropionic acid
thiolactic acid
thiophenoxyacetic acid
tiglic acid
o-tolylacetic acid
m-tolylacetic acid
p-tolylacetic acid
triacontanoic acid
tricarballylic acid
n-tridecanoic acid
3,4,5-trimethoxyphenylacetic acid
trimethylacetic acid
triphenylacetic acid
tropic acid
1,11-undecanedicarboxylic acid
undecandeioic acid
undecanoic acid
undecylenic acid
valeric acid
vinylacetic acid

CINNAMIC ACIDS p-acetamidocinnamic acid
p-aminocinnamic acid hydrochloride
2,3-Bis-(p-methoxyphenyl)-acrylic acid
o-carboxycinnamic acid
trans-cinnamic acid
α-cyano-3-hydroxycinnamic acid
2,4-dichlorocinnamic acid
2,6-dichlorocinnamic acid
3,4-dichlorocinnamic acid
3,4-dihydroxycinnamic acid
2,4-dimethoxycinnamic acid 2,5-dimethoxycinnamic acid
3,4-dimethoxycinnamic acid
3,5-dimethoxycinnamic acid
3,5-dimethoxy-4-hydroxycinnamic acid
4-ethoxy-3-methoxycinnamic acid
p-formylcinnamic acid
o-hydroxycinnamic acid
m-hydroxycinnamic acid
cis-p-hydroxycinnamic acid
p-hydroycinnamic acid
3-hydroxy-4-methoxycinnamic acid
4-hydroxy-3-methoxycinnamic acid
o-methoxycinnamic acid
m-methoxycinnamic acid
p-methoxycinnamic acid
α-methylcinnamic acid
p-methylcinnamic acid
o-nitrocinnamic acid

CINNAMIC ACIDS m-nitrtocinnamic acid
p-nitrocinnamic acid
α-phenylcinnamic acid
m-phenylenediacrylic acid
p-phenylenediacrylic acid
2,4,5-trimethoxycinnamic acid
3,4,5-trimethoxycinnamic acid

AROMATIC CARBOXYLIC ACIDS p-acetamidobenzoic acid
N-acetylanthranilic acid
2-acetylbenzoic acid
4-acetylbenzoic acid
acetylsalicylic acid
m-aminobenzoic acid
p-aminobenzoic acid
4-amino-3,5-dimethylbenzoic acid
5-aminosophthalic acid
2-amino-3-methylbenzoic acid
2-amino-4-methylbenzoic acid
2-amino-5-methylbenzoic acid
3-amino-4-methylbenzoic acid
4-amino-3-methylbenzoic acid
3-amino-2-naphthoic acid
5-amino-2-nitrobenzoic acid
3-amino-5-nitrosalicylic acid monohydrate
4-aminosalicylic acid
5-aminosalicylic acid
4-aminosulfonyl-1-hydroxy-2-naphthoic acid
o-anisic acid
m-anisic acid
p-anisic acid
anthracene-9-carboxylic acid
anthranilic acid
o-anthraniloylbenzoic acid
aristolochic acid
aurintricarboxylic acid
1,2,4,5-benzenetetracarboxylic acid
1,2,4-benzenetricarboxylic acid
1,3,5-benzenetricarboxylic acid
benzoic acid
2-benzoylbenzoic acid
4-benzoylbenzoic acid
2-bibenzylcarboxylic acid
2-biphenylcarboxylic acid
4-biphenylcarboxylic acid
4-n-butoxybenzoic acid
p-tert-butylbenzoic acid
3-tert-butyl-5-methylsalicylic acid
2-carboxybenzaldehyde
4-carboxybenzaldehyde
p-carbuxybenzenesulfonamide
o-carboxycinnamic acid
2'-carboxy-2-hydroxy-4-methoxybenzophenone

AROMATIC CARBOXYLIC ACIDS cholesteryl hydrogen phthalate
3-cyanobenzoic acid
4-cyanobenzoic acid
p-2-cyclohexenyloxybenzoic acid
3,4-diaminobenzoic acid
3,5-diaminobenzoic acid
3,5-diaminobenzoic acid hydrochloride
3,5-Di-tert-butyl-2,6-dihydroxybenzoic acid
3,5-Di-tert-butyl-4-hydroxybenzoic acid
4-diethylaminosalicylic acid
2,3-dihydroxybenzoic acid
2,4-dihydroxybenzoic acid
2,5-ddihydroxybenzoic acid
2,6-dihydroxybenzoic acid
3,4-dihydroxybenzoic acid
3,5-dihydroxybenzoic acid
3,5-dilsopropylsalicylic acid
2,3,-dimethoxybenzoic acid
2,4-dimethoxybenzoic acid
2,6-dimethoxybenzoic acid
3,4-dimethoxybenzoic acid
3,5-dimethoxybenzoic acid
3-dimethylaminobenzoic acid
4-dimethylaminobenzoic acid
4-dimethylaminosalicylic acid
2,4-dimethylbenzoic acid
2,5-dimethylbenzoic acid
2,6-dimethylbenzoic acid
3,4-dimethylbenzoic acid
3,5-dimethylbenzoic acid
2,6-nitrobenzoic acid
3,4-dinitrobenzoic acid
3,5-dinitrobenzoic acid
diphenic acid
5,5'-dithiobis-(2-nitrobenzoic acid)
2,2'-dithiosalicylic acid
p-dodecyloxybenzoic acid
p-ethoxybenzoic acid
flufenamic acid
1-fluorenecarboxylic acid
9-fluorenone-2-carboxylic acid
9-fluorenone-4-carboxylic acid
5-formylsalicylic acid
o-(hexadecylithio)-benzoic acid
homophthalic acid
m-hydroxybenzoic acid
p-hydroxybenzoic acid
2-(p-hydroxybenzoyl)-benzoic acid
4-hydroxy-3-methoxybenzoic acid
3-hydroxy-4-methylbenzoic acid
3-hydroxy-4-methyl-2-nitrobenzoic acid
1-hydroxy-2-naphthoic acid
3-hydroxy-2-naphthoic acid
3-hydroxy-4-nitrobenzoic acid
8-hydroxyquinoline-7-carboxylic acid

AROMATIC CARBOXYLIC ACIDS indole-5-carboxylic acid
isophthalic acid
metallitic trianhydride 3-methoxy-3-methylbenzoic acid
3-methoxy-2-nitrobenzoic acid
3-methoxy-4-nitrobenzoic acid
5-methoxysalicylic acid
p-(methylamino)-benzoic acid
N-methylanthranilic acid
2-methyl-3-nitrobenzoic acid
2-methyl-6-nitrobenzoic acid
3-methyl-2-nitrobenzoic acid
3-methyl-4-nitrobenzoic acid
3-methyl-6-nitrobenzoic acid
4-methyl-3-nitrobenzoic acid
3-methylsalicylic acid
5-methylsalicylic acid
p-(methylsulfonyl)-benzoic acid
4-methylsulfonyl-3-nitrobenzoic acid
p-(methylthio)-benzoic acid
4-methylthio-3-nitrobenzoic acid
5-(methylthio)-salicylic acid
2,3-naphthalenedicarboxylic acid
1-naphthoic acid
2-naphthoic acid
4-nitroanthranilic acid
o-nitrobenzoic acid
m-nitrobenzoic acid
p-nitrobenzoic acid
5-nitroisophthalic acid
p-nitroperoxybenzoic acid
3-nitrophthalic acid
4-nitrophthalic acid
nitroterephthalic acid
5-tert-octylsalicylic acid
3,4,9,10-perylenetetracarboxylic dianhydride
oo-henoxybenzoic acid
N-phenylanthranilic acid
α-phenyl-o-toluic acid
phthalic acid
o-phthalimidobenzoic acid
pieronylic acid
potassium hydrogen phthalate
salicylic acid
4,4'-sulfonyldibenzoic acid
syringic acid
terephthalic acid
tetramethylterephthalic acid
thiosalicylic acid
o-toluic acid
m-toluic acid
p-toluic acid
2,4,5-trimethoxybenzoic acid
2,4,6-trimethoxybenzoic acid
3,4,5-trimethoxybenzoic acid
2,4,6-trimethylbenzoic acid

ALICYCLIC CARBOXYLIC ACIDS 1-adamantanecarboxylic acid
trans-4-(aminomethyl)-cyclohexanecarboxylic acid
betulinic acid
di-3-camphorcarboxylic acid
d-camphoric acid
cyclobutanecarboxylic acid
1,1-cyclobutanedicarboxylic acid
trans-1,2-cyclobutanedicarboxylic acid
cycloheptanecarboxylic acid
4-cycloheptene-1-carbyxolic acid
cyclohexanecarboxylic acid
cis-1,2-cyclohexaneeedicarboxylic acid
trans-1,2-cyclohexanedicarboxylic acid
trans-1,4-cyclohexanedicarboxylic acid
4-cyclooctene-1-carboxylic acid
cyclopentanecarboxylic acid
cis,cis,cis,cis-1,2,3,4-cyclopentane-tetracarboxylic acid
cyclopropanecarboxylic acid
9-fluorenecarboxylic acid
gibberellic acid
β-glycyrrhetinic acid
hexahydro-4-methylphthalic acid
1-hydroxycycloheptanecarboxylic acid
9-hydroxy-9-fluorenecarboxylic acid
1-(p-methoxyphenyl)-1-cyclohexane-carboxylic acid
1-(p-methoxyphenyl)-1-cyclopentane-carboxylic acid
1-(p-methoxyphenyl)-1-cyclopropane-carboxylic acid
1-methyl-1-cyclohexanecarboxylic acid
1-methylindene-2-carbyxylic acid
1-phenyl-1-cyclohexanecarboxylic acid
1-phenylcyclopentanecarboxylic acid
1-phenyl-1-cyclopropanecarboxylic acid
trans-2-phenylcyclopropanecarboxylic acid
quinic acid
shikimic acid
1-(p-tolyl)-1-cyclohexanecarboxylic acid
1-(p-tolyl)-1-cyclopentanecarboxylic acid
1-(p-tolyl)-1-cyclopropanecarboxylic acid

OTHER CARBOXYLIC ACIDS

N-acetylneuraminic acid
alginic acid
2-aminonicotinic acid
6-aminopenicillanic acid
3-aminopyrazole-4-carboxylic acid
1-benzylindole-3-carboxylic acid
cinnoline-4-carboxylic acid
citrazinic acid
coumalic acid monohydrate
coumarin-3-carboxylic acid
diethylstilbestrol monoglucuronide
4,8-dihydroxyuinoline-2-carboxylic acid
2,3,4,6-di-O-isopropylidene-2-keto-L-gulonic acid monohydrate

OTHER CARBOXYLIC ACIDS 6,6'-dithiodinicotinic acid
5-ethyl-2-indolecarboxylic acid
ferrocenecarboxylic acid
1,1'-ferrocenedicarboxylic acid
3,4-furandicarboxylic acid
2-furoic acid
3-furoic acid
hyalueronic acid
5-hydroxy-2-indolecarboxylic acid
4-hydroxy-7-methyl-1,8-naphthyridine-3-carboxylic acid
2-hydroxy-6-methylpyridine-3-carboxylic acid
6-hydroxynicotinic acid
4-hydroxy-6-nitro-3-quinolinecarboxylic acid
3-hydroxypicolinic acid
4-hydroxyquinoline-2-carboxylic acid
3-hydroxy-2-quinoxalinecarboxylic acid
indole-2-carboxylic acid
DL-isocitric acid lactone
isodehydracetic acid
isonicotinic acid
isonipecotic acid
1-isoquinolinecarboxylic acid
5-methoxyindole-2-carboxylic acid
1-methylindole-2-carboxylic acid 5-methylindole-2-carboxylic acid
1-methyl-5-oxo-3-pyrrolidinecarboxylic acid
5-methyl-3-phenylisoxazole-4-carboxylic acid
N-methylpyrrole-2-carboxylic acid
5-methyl-2-thiophenecarboxylic acid
nalidixic acid
nicotinic acid
nicotinic acid N-oxide
5-nitro-2-furoic acid
picolinic acid
picolinic acid N-oxide pipecolinic acid
2-piperidinocinchoninic acid
2-pyrazinecarboxylic acid
2,3-pyrazinedicarboxylic acid
3,5-pyrazoledicarboxylic acid
2,6-pyridinedicarboxylic acid
3,4-pyridinedicarboxylic acid
3,5-pyridinedicarboxylic acid
pyrrole-2-carboxylic acid
L-2-pyrrolidone-5-carboxylic acid
quinaldic acid
3-quinolinecarboxylic acid
tetrahydrofuran-2,3,5-tetracarboxylic acid
L-thiazolidine-4-carboxylic acid
2-thiophenecarboxylic acid
xanthene-9-carboxylic acid A number of solvents may be used for preparing the carboxylic acid solution including 1,1,2 trichloro 1,2,2 trifluoroethane, chloroform, tetrahydrofuran, methanol and methyl ethyl ketone. The concentration of the carboxylic acid solution should be such that the treatment of the carrier particle would provide a monomolecular about the surface thereof. This is preferable since the adherance of the molecules upon the carrier particle is by adhesion and any excess would tend to be detremented as the excess would easily be separated and tend to contaminate the development powder. To obtain a monomolecular, the concentration would be a function of the surface area to be covered, the molecular weight of the carboxylic acid as well as the molecular dimension of the acid. It has been found that a concentration of 0.001 to 0.030 grams of acid to 100 grams of iron powder has been a satisfactory range for the material disclosed herein. It will be understood, however, that this range is not all encompassing as the concentration may fall below or above this satisfactory range depending upon the acid selected.

The amount of acid required may be calculated in accordance with the following illustration using stearic acid.

The surface area of the iron powder was measured by BET and was found to be 0.05054 $m^2/gm = 0.05054$ $m^2/gm \times 10^4$ $cm^2/m^2 = 505.4$ $cm^2/gm$.

The area covered by a single molecule of fatty acid is equal to $21 \times 10^{-16}$ sq cm/molecule.

Therefore 505.4 $cm^2/gm$ iron//$21 \times 10^{-16}$ $cm^2/molecule = 24.07 \times 10^{16}$ molecule/gm iron.

Since there are $6.02 \times 10^{23}$ (Avogadro's number) molecules per mole of any substance then $24.07 \times 10^{16}$ molecules/gm iron//$6.02 \times 10^{23}$ molecules/mole $= 4 \times 10^{-7}$ moles acid/gm iron.

For stearic acid whose molecular weight is 284.5 one would need $4 \times 10^{-7}$ moles acid $\times$ 100 gms iron $\times$ 284.5 = 0.011380 gms.

A number of commercial toners were used with the carrier particle treated in accordance with the instant invention and it was found that the treated particle served well with any of these toners. Consequently it does not appear that the selection of toner is important relative to the treated carrier particle.

EXAMPLE I

Five hundred grams of iron powder was added to a solution of 0.075 g of myristic acid dissolved in 100 mls. of 1,1,2 trichloro 1,2,2 trifluoroethane. This mixture was then stirred at room temperature until the solvent was completely evaporated. A development powder was then prepared using 97.6 gms. of thusly treated iron and 2.4 gms. of toner made from an expoxy base resin modified with polyvinyltoluene. The resulting charge to mass ratio (C/M) was 5.7 $\mu C/gm$.

EXAMPLE II

Iron powder was treated as in Example I except that the solvent was evaporated in an oven at 70 degrees C. A developer was prepared as previously described and the resulting C/M was 10.3 $\mu C/gm$.

EXAMPLE III–XVI

The acids listed in Table I were used to treat iron as described in Example I, the solution in each case having a concentration of 0.015 gms/100 gms. iron. Development powders were then prepared as described in Example II using the following toners:

Toner U—The toner of Examples I and II.

Toner V—A styrene acrylic copolymer described in Example IV of U.S. Pat. No. 3,980,576.

Toner W—A polyester resin described in U.S. Pat. No. 3,681,106 and available from Xerox Corporation under the Trademark 3100 DRY INK.

Table I shows the C/M obtained using various toners with the acids from Table I.

TABLE I

| acid Number | Acid Trivial Name | Acid Formula |
|---|---|---|
| 9 | 2 ethylhexanoic | $CH_3(CH_2)_3CH(C_2H_5)COOH$ |
| 2 | palmitic | $CH_3(CH_2)_{14}COOH$ |
| 1 | myristic | $CH_3(CH_2)_{12}COOH$ |
| 3 | stearic | $CH_3(CH_2)_{16}COOH$ |
| 4 | oxalic | HOOCCOOH |
| 5 | citric | $HOC(COOH)CH_2COOH)_2$ |
| 6 | tannic | $C_{76}H_{52}O_{46}$ |
| 7 | tartaric | $HOCO(CHOH)_2COOH$ |
| 8 | ethylenediamine tetraacetic | $(HOCOCH_2)_2N(CH_2)N(CH_2COOH)_2$ |
| 10 | benzoic | $C_6H_5COOH$ |
| 11 | phthalic | $1,2\text{-}C_6H_4(COOH)_2$ |
| 12 | salicylic | $2\text{-}HOC_6H_4COOH$ |
| 13 | gallic | $3,4,5\text{-}(HO)_3C_6H_2COOH$ |
| 14 | p-nitrobenzoic | $4\text{-}O_2NC_6H_4COOH$ |
| 15 | phenoxyacetic | $C_6H_5OCH_2COOH$ |

TABLE II

| Acid | Conc. g/100g iron | C/M @ 20% RH micro coulombs/gram toner U | V | W |
|---|---|---|---|---|
| .2 | 0.015 | + 16.3 | + 12.9 | − 15.9 |
| .3 | 0.015 | + 17.6 | + 17.9 | − 15.1 |
| .4 | 0.015 | + 13.7 | | |
| .5 | 0.006 | + 16.0 | | |
| .6 | 0.015 | + 14.1 | | |
| .7 | 0.008 | + 12.4 | | |
| .8 | 0.004 | + 8.5 | | |
| .9 | 0.015 | + 25.5 | + 17.8 | − 12.7 |
| 10 | 0.015 | + 12.2 | + 6.9 | 21.4 |
| 11 | 0.006 | + 9.3 | | |
| 12 | 0.008 | + 11.1 | | |
| 13 | 0.006 | + 12.9 | | |

TABLE II-continued

| Acid | Conc. g/100g iron | C/M @ 20% RH micro coulombs/gram toner U | V | W |
|---|---|---|---|---|
| 14 | 0.015 | +21.7 | | |
| 15 | 0.015 | + 8.9 | | |

TABLE III shows the C/M obtained using toner U and varying the acid concentration (gm/acid/100 gm iron).

TABLE III

| Acid | C/M iron | C/M iron treated w/Freon TA & no acid | 0.004 | 0.008 | 0.015 | 0.030 |
|---|---|---|---|---|---|---|
| 2-ethyl hexanoic | 15.6 | 15.6 | 29.0 | 27.5 | 21.4 | 24.0 |
| stearic | 15.6 | 15.6 | 18.9 | 11.9 | 17.6 | 6.7 |

The following data indicates the advantage of maintaining anhydrous conditions.

A molecular sieve (Davison Chemical Co., Baltimore, Maryland, Grade 574,) having an effective pore size of 4 A°, and an 8-12 mesh, was added to 20 ml of Freon TA, a solvent commercially available from DuPont Corp. of 89 W/O 1,1,2 trichloro 1,2,2 trifluoroethane and 11 w/O accetone containing 0.005 gm 2 ethyl hexanoic acid. The solutions were then used to treat 100 grams of iron powder and the results obtained are shown in Table IV.

TABLE IV

| Untreated | Freon No Acid | Freon TA having 2 ethyl hexanoic No Sieve | 0.5gm Sieve | 1.0gm Sieve | 2.0gm Sieve |
|---|---|---|---|---|---|
| C/M 13.0 | 13.2 | 10.2 | 17.4 | 19.4 | 16.1 |

The following results show the protective action against oxidation after samples were exposed to 90 degrees F. and 85% relative humidity for one week.

The reflectance was determined with a Hunter Lab color/difference Meter D-25D2.

| | initial reflectivity | reflectivity after 1 week |
|---|---|---|
| untreated | L + +40.4 a −0.5, b +1.7 | +38.9 −0.7 +2.1 |
| treated with 0.015g 2-ethyl hexanoic acid 100g of non | L + +38.9 a −0.6, b +1.8 | +39.3 −0.7 +1.9 |

What is claimed is:

1. A carrier for use in a magnetic brush development unit for the electrophotographic development of latent electro-static images consisting of ferromagnetic particles having adhered to the surface thereof a monomolecular layer of a non-halogenated carboxylic acid.

2. The carrier of claim 1 wherein said carboxylic acid is selected from the group consisting of aliphatic carboxylic acid, cinnamic acids, aromatic carboxylic acid and alicyclic.

3. The carrier particle of claim 1 wherein said carrier particle is iron.

* * * * *